US009969539B2

(12) United States Patent
Genaw, Jr.

(10) Patent No.: US 9,969,539 B2
(45) Date of Patent: May 15, 2018

(54) CLOSURE CAP WITH FLOW RESTRICTION MEMBER

(71) Applicant: Nestec S.A., Vevey (CH)

(72) Inventor: Joel Dean Genaw, Jr., Hesperia, MI (US)

(73) Assignee: Nestec S.A., Vevey (CH)

( * ) Notice: Subject to any disclaimer, the term of this patent is extended or adjusted under 35 U.S.C. 154(b) by 46 days.

(21) Appl. No.: 14/702,880

(22) Filed: May 4, 2015

(65) Prior Publication Data

US 2015/0321801 A1 Nov. 12, 2015

Related U.S. Application Data

(60) Provisional application No. 61/989,497, filed on May 6, 2014.

(51) Int. Cl.
*B65D 51/18* (2006.01)
*B65D 47/06* (2006.01)
(Continued)

(52) U.S. Cl.
CPC ..... *B65D 47/06* (2013.01); *B65D 47/122* (2013.01); *B65D 47/123* (2013.01);
(Continued)

(58) Field of Classification Search
CPC .... B65D 47/06; B65D 47/122; B65D 47/123; B65D 47/126; B65D 47/128;
(Continued)

(56) References Cited

U.S. PATENT DOCUMENTS 2,665,037 A * 1/1954 Zublin ..... B65D 47/18 222/162
3,220,588 A * 11/1965 Lipari ..... A61J 1/2093 206/222

(Continued)

FOREIGN PATENT DOCUMENTS

GB 2359806 A 9/2001
RU 2397125 8/2010

OTHER PUBLICATIONS

International Search Report and Written Opinion from corresponding PCT patent application No. PCT/IB2015/053245 dated Jul. 16, 2015.

*Primary Examiner* — Charles P Cheyney
(74) *Attorney, Agent, or Firm* — Gary M. Lobel, Esq.

(57) ABSTRACT

A closure cap for a container having a spout is described. The closure cap includes a tubular base, a flexible cover, and a flow restriction member. The tubular base is positionable about and sealingly engageable with the spout. The flexible cover is extends over the tubular base and movable between a non-depressed position and a depressed position. The flow restriction member is detachably mounted to the tubular base such that the flow restriction member is in a spaced, coaxial relationship with the spout when the tubular base is engaged with the spout and when the flexible cover is in the non-depressed position and such that the flow restriction member is detached from the tubular base and positioned on and engaged with the spout of the container when the flexible cover is moved to the depressed position.

6 Claims, 4 Drawing Sheets

(51) Int. Cl.
*B65D 47/12* (2006.01)
*B65D 75/58* (2006.01)

(52) U.S. Cl.
CPC ..... *B65D 47/126* (2013.01); *B65D 47/128* (2013.01); *B65D 75/5883* (2013.01)

(58) Field of Classification Search
CPC ..... B65D 75/5883; B65D 2251/0015; B65D 47/10; B65D 47/103; B65D 47/106
USPC ..... 222/499, 525, 545, 568, 92–107, 566, 222/575, 544; 215/317
See application file for complete search history.

(56) References Cited

U.S. PATENT DOCUMENTS 3,232,499 A * 2/1966 Esposito, Jr. ..... B65D 47/06 222/499
3,315,830 A * 4/1967 Flynn ..... B65D 41/0492 215/334
4,150,761 A * 4/1979 Collins ..... A45F 3/16 141/380
4,273,247 A * 6/1981 Earls ..... B65D 41/26 141/380
4,408,700 A * 10/1983 Fillmore ..... B65D 47/247 222/153.06
4,570,826 A * 2/1986 Fattori ..... B65D 47/2025 222/511
4,706,827 A * 11/1987 Cabernoch ..... A61J 9/001 215/11.1
4,830,234 A 5/1989 Odet
5,462,200 A * 10/1995 Weiler ..... B65D 51/222 222/420
5,680,965 A * 10/1997 Beck ..... B65D 47/243 222/153.06
5,850,951 A * 12/1998 Hayes ..... B65D 43/0212 215/228
6,039,218 A * 3/2000 Beck ..... B65D 41/3447 215/252
8,109,236 B2 * 2/2012 Brodowski ..... A01N 25/34 119/71
2003/0205584 A1 11/2003 Niggemyer
2006/0006194 A1 1/2006 Niggemyer et al.

* cited by examiner

CLOSURE CAP WITH FLOW RESTRICTION MEMBER

BACKGROUND

1. Field of the Inventive Concepts

The inventive concepts disclosed and claimed herein relate to container sealing, and more particularly, but not by way of limitation, to a closure cap with a flow-restriction member for optionally reducing the otherwise free flow of material from a container, such as a flexible container for flowable foods and liquids.

2. Brief Description of Related Art

Flexible pouches for containing food and beverage products are frequently marketed for use by infants and small children. The flexible pouches are convenient, inexpensive, and provide ease of use. Typically, the flexible pouches include a spout for discharging the material and a removable closure cap for sealing the pouch. With the closure cap removed, product is able to flow freely from the spout of the pouch by the user pouring or squeezing the pouch. In packaging foods and juices for infant and child consumption, however, a container with a spout providing a free flowing product may have drawbacks in terms of spills and delivering the product at a rate that it cannot be consumed without risk of choking.

To this end, a need exists for a closure cap with a flow restricting member for optionally reducing the otherwise free flow of product from the container. It is to such a closure cap that the inventive concepts disclosed herein are directed.

DETAILED DESCRIPTION OF EXEMPLARY EMBODIMENTS

Figure 1:
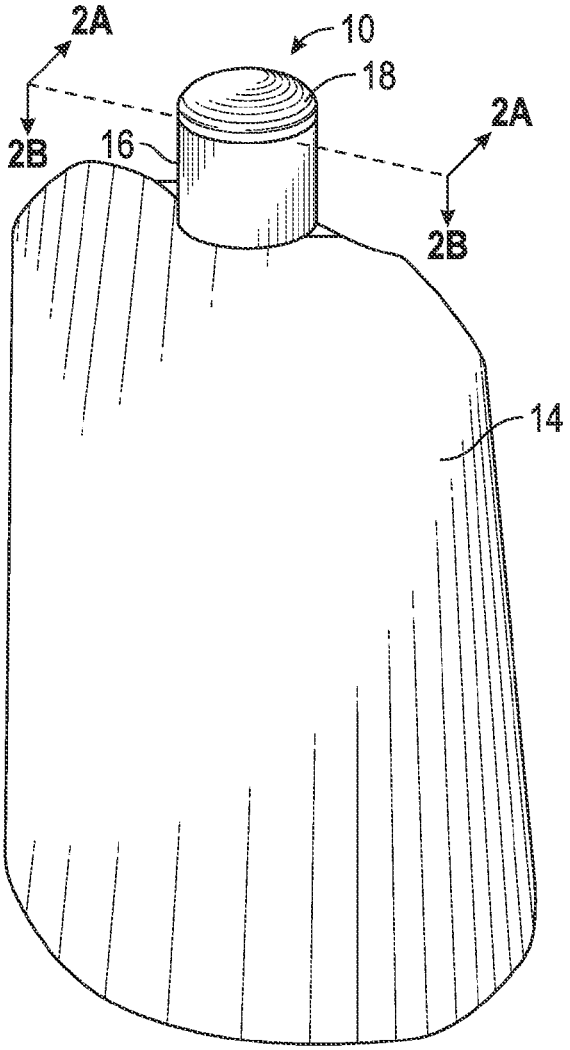
FIG. 1 is a perspective view of a closure cap constructed in accordance with the inventive concepts disclosed herein shown positioned on a container.

In the following detailed description of embodiments of the inventive concepts, numerous specific details are set forth in order to provide a more thorough understanding of the inventive concepts. However, it will be apparent to one of ordinary skill in the art that the inventive concepts disclosed and claimed herein may be practiced without these specific details. In other instances, well-known features have not been described in detail to avoid unnecessarily complicating the instant disclosure.

As used herein, the terms "comprises," "comprising," "includes," "including," "has," "having" or any other variation thereof, are intended to cover a non-exclusive inclusion. For example, a process, method, article, or apparatus that comprises a list of elements or steps is not necessarily limited to only those elements or steps and may include other elements, steps, or features not expressly listed or inherently present therein.

Unless expressly stated to the contrary, "or" refers to an inclusive or and not to an exclusive or. For example, a condition A or B is satisfied by anyone of the following: A is true (or present) and B is false (or not present), A is false (or not present) and B is true (or present), and both A and B are true (or present).

In addition, use of the "a" or "an" are employed to describe elements and components of the embodiments herein. This is done merely for convenience and to give a general sense of the inventive concepts. This description should be read to include one or at least one and the singular also includes the plural unless it is obvious that it is meant otherwise.

Throughout this disclosure and the claims, the terms "about," "approximately," and "substantially" are intended to signify that the item being qualified is not limited to the exact value specified, but includes some slight variations or deviations therefrom, caused by measuring error, manufacturing tolerances, stress exerted on various parts, wear and tear, or combinations thereof, for example.

The use of the term "at least one" will be understood to include one as well as any quantity more than one, including but not limited to each of, 2, 3, 4, 5, 10, 15, 20, 30, 40, 50, 100, and all integers there between. The term "at least one" may extend up to 100 or 1000 or more, depending on the term to which it is attached; in addition, the quantities of 100/1000 are not to be considered limiting, as higher limits may also produce satisfactory results. Singular terms shall include pluralities and plural terms shall include the singular unless indicated otherwise.

The term "or combinations thereof" as used herein refers to all permutations and/or combinations of the listed items preceding the term. For example, "A, B, C, or combinations thereof" is intended to include at least one of: A, B, C, AB, AC, BC, or ABC, and if order is important in a particular context, also BA, CA, CB, CBA, BCA, ACB, BAC, or CAB. Continuing with this example, expressly included are combinations that contain repeats of one or more item or term, such as BB, AAA, AAB, BBC, AAABCCCC, CBBAAA, CABABB, and so forth. The skilled artisan will understand that typically there is no limit on the number of items or terms in any combination, unless otherwise apparent from the context.

Finally, as used herein any reference to "one embodiment" or "an embodiment" means that a particular element, feature, structure, or characteristic described in connection with the embodiment is included in at least one embodiment. The appearances of the phrase "in one embodiment" in various places in the specification are not necessarily referring to the same embodiment, although the inventive concepts disclosed herein are intended to encompass all combinations and permutations including one or more of the features of the embodiments described herein.

Figure 2A:
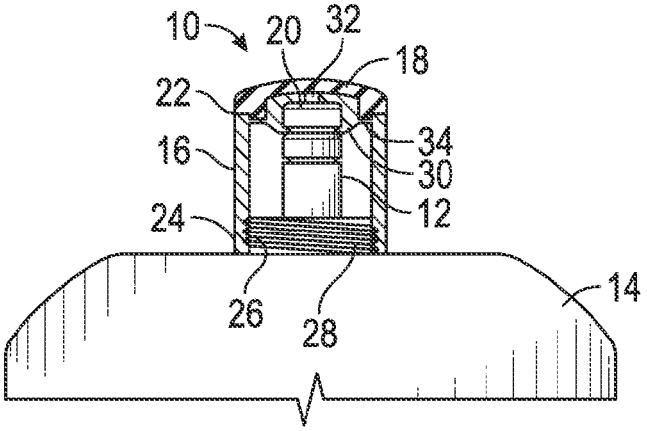
FIG. 2A is a vertical sectional view of the closure cap taken along line 2A-2A of FIG. 1.
Figure 2B:
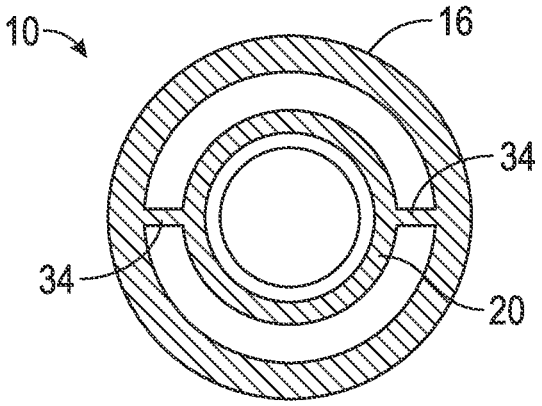
FIG. 2B is a sectional view of the closure cap taken along line 2B-2B of FIG. 2A.

Referring now the drawings, and more particularly to FIGS. 1, 2A, and 2B, a closure cap 10 constructed in accordance with the inventive concepts disclosed herein is illustrated in sealing engagement with a spout 12 of a container 14, such as a flexible pouch. The closure cap 10 is particularly well suited for sealing containers used for flowable foods and juices which are marketed for infants and children where the user, i.e., a parent desires to limit the otherwise free flow of the product from the container for ease of consumption and to avoid spills. Flexible pouches are well known by those having ordinary skill in the art and, therefore, will not be described in detail herein. In general, the container 14 may be comprised of any non-permeable flexible material. For example, the container 14 may be made of one or more flexible sheets, such as polymer sheets or foil sheets. The container 14 may be used to contain any flowable material. Non-exclusive examples of flowable material include food, beverages, granules, and gases. In one example, the flowable material may be pureed food products or beverages designed for consumption by children.

In one embodiment, the closure cap 10 includes a rigid tubular base 16, a flexible cover 18, and a flow restriction member 20 that may be optionally deployed by a user to reduce or restrict the otherwise free flow of product from the container 14.

The tubular base 16 is shown to be generally a circular cylinder having an upper end 22 and a lower end 24. The tubular base 16 can be molded from a variety of suitable rigid polymers and plastics, such as, for example, polyethylene. The tubular base 16 may include internal threads 26 for threaded sealing engagement with corresponding external threads 28 of the spout 12. However, it should be appreciated that the lower end of the tubular base 16 may engage with the spout in other ways, such as snap-fit.

Figure 3:
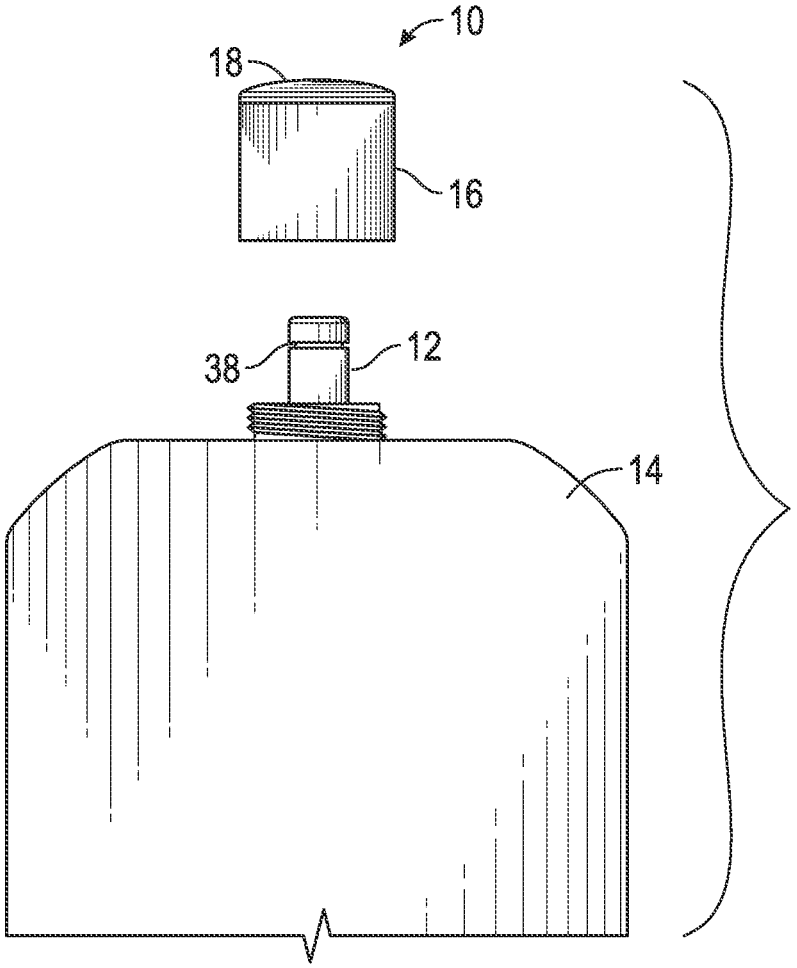
FIG. 3 is an elevation view of the closure cap shown removed from the container to expose a spout of the container.
Figure 4A:
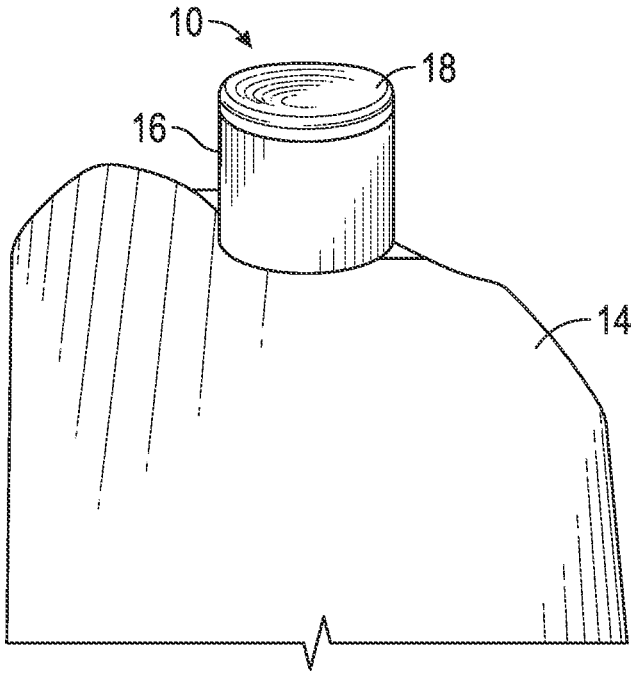
FIG. 4A is a perspective view illustrating the closure cap in a depressed position.
Figure 4B:
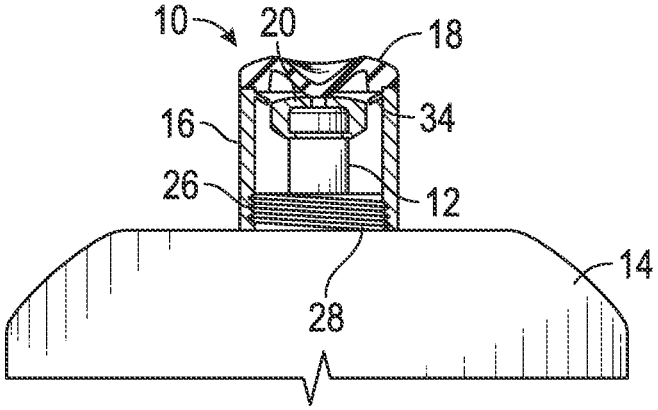
FIG. 4B is an elevation view, in partial section, of the closure cap taken along line 4B-4B of FIG. 4A.

Referring now to FIGS. 1-4, the flexible cover 18 extends over the upper end 22 of the tubular base 16 and is movable between a non-depressed position (FIGS. 1, 2A, and 3) and a depressed position (FIGS. 4A and 4B). The flexible cover 18 can be over-molded onto the tubular base 16 from a variety of rubber or soft plastic materials.

The flow restriction member 20 has an annular wall 30 forming an aperture 32 and is positionable over and engageable with the spout 12 of the container 14. The aperture 32 is illustrated as being a central slot, but the aperture 32 may be a variety of shapes and sizes, such as a circular hole, a slit, a cross-slit, or a hole with a fanciful shape, such as star shaped, or more than one aperture, which will restrict the otherwise free flow of material from the container 14 when the flow restriction member 20 is positioned on the spout 12 as described below. The aperture 32 of the flow restriction member 20 is fabricated to function as a flow-restricting passage and thus is of smaller diameter than the flow passage of the spout 12. Thus, when the flow restriction member 20 is positioned securely over the spout 12, the otherwise free flow of material through the spout is restricted.

As illustrated in FIGS. 2A and 2B, the flow restriction member 20 is housed by the tubular base 16 and the flexible cover 18. In one embodiment, the flow restriction member 20 is mounted to the tubular base 16 such that the flow restriction member 20 is in a spaced, coaxial relationship with the spout 12 of the container 14 when the tubular base 16 is sealingly engaged with the spout 12 and when the flexible cover 18 is in the non-depressed position.

The flow restriction member 20 is further mounted to the tubular base 16 such that the flow restriction member 20 is detached from the tubular base 16 and positioned on and engaged with the spout 12 of the container 14 when the flexible cover 18 is moved to the depressed position, as illustrated in FIGS. 4A and 4B. In one embodiment, the tubular base 16 and the flow restriction member 20 may be formed as a one piece unit from a suitable polymer or plastic such that the flow restriction member 20 is connected to the tubular base 16 with a plurality of frangible bridges 34. Alternatively, it should be appreciated that the flow restriction member 20 may formed as a separate component and detachably mounted to the tubular base 16 with a suitable adhesive or by press-fit, or detachably mounted to the underside of the flexible cover 18 with a suitable adhesive or by press-fit.

Figure 4C:
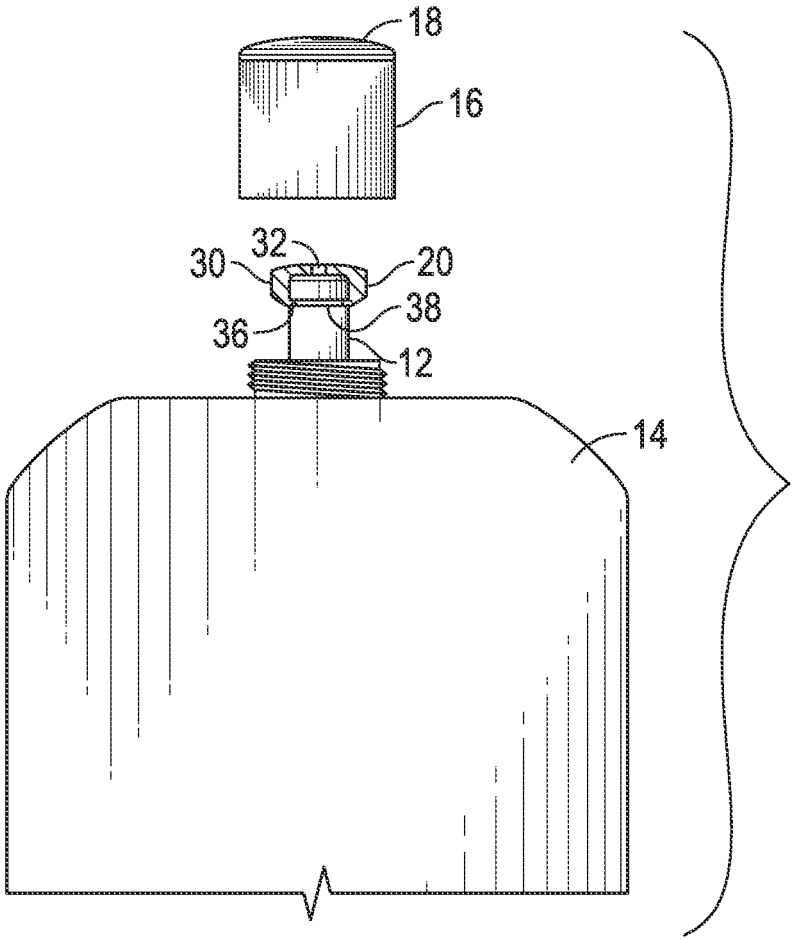
FIG. 4C is an elevation view showing a flow restriction member of the closure cap attached to the spout of the container.

As best illustrated in FIGS. 4B and 4C, the flow restriction member 20 may terminate in an inwardly projecting peripheral edge 36 for engaging a corresponding annular groove 38 formed about the periphery of the spout 12 in response to pressure being applied to flexible cover 18. Alternatively, the peripheral edge 36 may engage an annular bead or detent (not shown) of the spout 12. To facilitate the flow restriction member moving over the distal end of the spout 12, the peripheral edge 36 may be beveled.

As can be seen with reference to FIG. 2A, when the spout 12 is sealed with the closure cap 10, the flow restriction member 20 in a co-axial, spaced relationship to the spout 12. A user has the option to remove the closure cap 10 and dispense the flowable product unhindered (FIG. 3). However, if flow restriction is desired, the user can depress the flexible cover 18 while the closure cap 10 is engaged with the spout 12 and thereby detach the flow restriction member 20 from the tubular base 16 and secure the flow restriction member 20 on the spout 12 of the container 14 (FIGS. 4A and 4B). The frangible bridges 34 are broken and the inwardly projecting peripheral edge 36 of the flow restriction member 20 engages corresponding groove 38 of the spout 12. The flow restriction member 20 is thereby positioned securely on the spout 12 to restrict the flow of product from the container 14.

From the above description, it is clear that the inventive concepts disclosed and claimed herein are well adapted to carry out the objects and to attain the advantages mentioned herein, as well as those inherent in the invention. While exemplary embodiments of the inventive concepts have been described for purposes of this disclosure, it will be understood that numerous changes may be made which will readily suggest themselves to those skilled in the art and which are accomplished within the spirit of the inventive concepts disclosed and claimed herein.

What is claimed is:

1. A closure cap in combination with a spout for a container, the spout defining a flow passage, the closure cap comprising:

a rigid tubular base having an upper end and a lower end, the tubular base positioned about and sealingly engaged with the spout;

a flexible cover extending over the upper end of the tubular base and being movable between a non-depressed position and a depressed position; and a flow restriction member having an annular wall forming an aperture and being positionable over and engageable with the spout, the flow restriction member connected to the tubular base in a way that the flow restriction member is in a spaced, coaxial relationship with the spout of the container when the flexible cover is in the non-depressed position and the flow restriction member is caused to detach from the tubular base and be positioned on and attached to the spout when the flexible cover is moved to the depressed position, wherein when the flexible member is in the non-depressed position, a material in the container is permitted to flow through the flow passage of the spout at a first rate when closure cap is removed from the spout; and wherein when the flexible member is in the depressed position and the flow restriction member is positioned on and attached to the spout, the material is permitted to flow through the flow passage of the spout and the aperture of the flow restriction member at a second rate, which is less than the first rate, when the closure cap is removed from the spout.

2. The combination of claim 1, wherein the flow restriction member and the tubular base are formed as a one piece unit.

3. The combination of claim 1, wherein the flow restriction member is connected to the tubular base with a plurality of frangible bridges.

4. The combination of claim 1, wherein the spout has an annular groove, and wherein the annular wall of the flow restriction member terminates in an inwardly projecting peripheral edge receivable in the annular groove of the spout.

5. The combination of claim 1, wherein the tubular base is threadingly engageable with the spout.

6. A method of restricting the flow of material from a container having a spout defining a flow passage from the container, the method comprising:

sealingly engaging a closure cap to the spout of the container, the closure cap having a rigid tubular base, a flexible cover extending over an upper end of the tubular base and movable between a non-depressed position and a depressed position, and a flow restriction member connected to the tubular base and having an annular wall forming an aperture;

pressing the flexible cover of the closure cap to move the flexible cover to the depressed position and cause the flow restriction member to detach from the tubular base and be positioned on and attached to the spout of the container; and removing the tubular base and the flexible cover of the closure cap from the spout to permit material to flow through the flow passage of the spout and the aperture of the flow restriction member, wherein when the flexible member is in the non-depressed position, a material in the container is permitted to flow through the flow passage of the spout at a first rate when the closure cap is removed from the spout; and wherein when the flexible member is in the depressed position and the flow restriction member is positioned on and attached to the spout, the material is permitted to flow through flow passage of the spout and the aperture of the flow restriction member at a second rate, which is less than the first rate, when the closure cap is removed from the spout.

* * * * *